US008536771B2

(12) United States Patent
Nakamura et al.

(10) Patent No.: US 8,536,771 B2
(45) Date of Patent: Sep. 17, 2013

(54) SURFACE FOR SUPPORTING A SHEET PACKING IN A SPARK PLUG

(75) Inventors: Mai Nakamura, Aichi (JP); Akira Suzuki, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 177 days.

(21) Appl. No.: 13/138,392

(22) PCT Filed: Feb. 3, 2010

(86) PCT No.: PCT/JP2010/000628
§ 371 (c)(1),
(2), (4) Date: Aug. 10, 2011

(87) PCT Pub. No.: WO2010/095376
PCT Pub. Date: Aug. 26, 2010

(65) Prior Publication Data

US 2011/0298353 A1 Dec. 8, 2011

(30) Foreign Application Priority Data

Feb. 17, 2009 (JP) ..... 2009-033533

(51) Int. Cl.
*H01T 13/36* (2006.01)

(52) U.S. Cl.
USPC ..... 313/145

(58) Field of Classification Search
None
See application file for complete search history.

(56) References Cited

U.S. PATENT DOCUMENTS

| | | | | |
|---|---|---|---|---|
| 2001/0002096 | A1 | 5/2001 | Honda et al. | 313/143 |
| 2007/0159047 | A1 | 7/2007 | Ishinada et al. | 313/143 |
| 2008/0054778 | A1 | 3/2008 | Kumagai et al. | 313/143 |

FOREIGN PATENT DOCUMENTS

| | | |
|---|---|---|
| JP | 2-21369 | 2/1990 |
| JP | 2001-155839 | 6/2001 |
| JP | 2005-190762 | 7/2005 |
| JP | 2006-222098 | 8/2006 |
| JP | 2006-236906 | 9/2006 |
| JP | 2007-184194 | 7/2007 |
| JP | 2008-84841 | 4/2008 |

OTHER PUBLICATIONS

Form PCT/ISA/210—Int'l Search Report (from corresponding Int'l Patent App. No. PCT/JP2010/000628-English verion only); 2 pages.

*Primary Examiner* — Britt D Hanley
(74) *Attorney, Agent, or Firm* — Kusner & Jaffe

(57) ABSTRACT

A spark plug comprised of an insulator having a stepped portion on an outer circumferential portion thereof, the stepped portion tapering frontward in the direction of the axis of the spark plug, an annular sheet packing and a metallic shell having a taper portion provided on an inner circumferential portion thereof and tapering frontward in the direction of the axis of the spark plug, the metallic shell holding the insulator through a rear end portion thereof being crimped, the stepped portion being seated on the taper portion via the sheet packing, and the taper portion having a groove therein.

8 Claims, 5 Drawing Sheets

FIG. 6
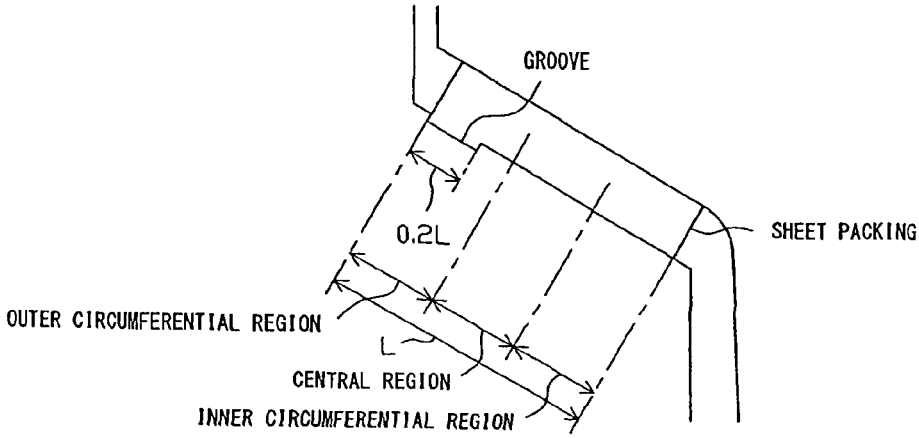
FIG. 6(a)
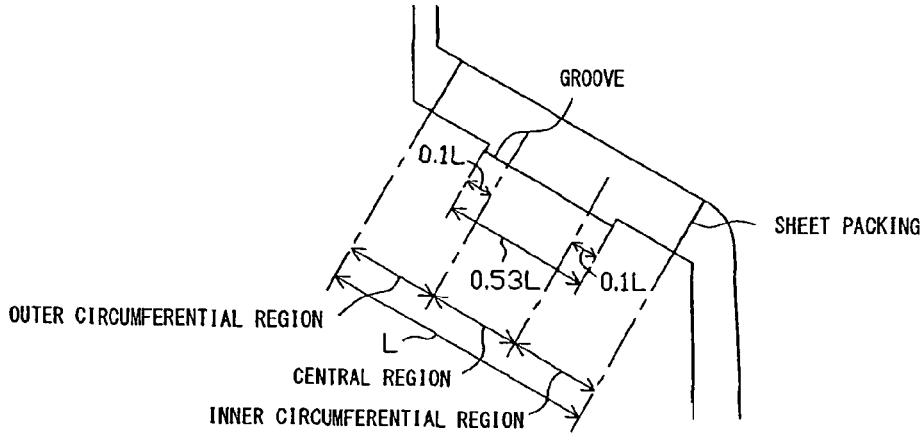
FIG. 6(b)
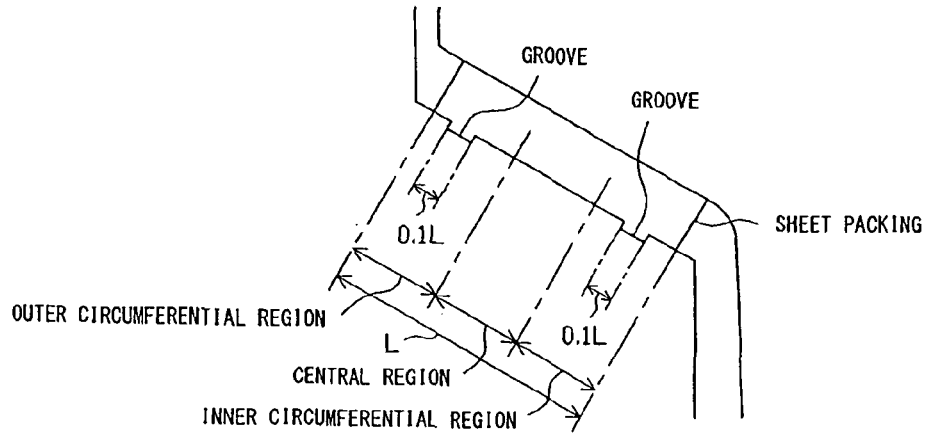
FIG. 6(c)

SURFACE FOR SUPPORTING A SHEET PACKING IN A SPARK PLUG

FIELD OF THE INVENTION

The present invention relates to a spark plug for use in an internal combustion engine.

BACKGROUND OF THE INVENTION

A spark plug is mounted to, for example, an internal combustion engine (engine) and used to ignite an air-fuel mixture in a combustion chamber. Generally, a spark plug includes an insulator having an axial hole, a center electrode inserted into a front end portion of the axial hole, a terminal electrode inserted into a rear end portion of the axial hole, a metallic shell provided externally of the outer circumference of the insulator, and a ground electrode provided at a front end portion of the metallic shell. The ground electrode is adapted to form a spark discharge gap in cooperation with the center electrode. When high voltage is applied to the center electrode, a discharge is generated across the spark discharge gap between the two electrodes, thereby igniting the air-fuel mixture.

The insulator is inserted into the interior of the metallic shell and held by the metallic shell by means of a rear end opening portion of the metallic shell being crimped radially inward in a state in which a stepped portion formed on an outer circumferential portion of the insulator is seated on a taper portion formed on an inner circumferential portion of the metallic shell. At this time, in order to prevent outward leakage of the air-fuel mixture and the like which enter between the metallic shell and the insulator, an annular sheet packing intervenes between the taper portion of the metallic shell and the stepped portion of the insulator (refer to, for example, Japanese Patent Application Laid-Open (kokai) No. 2005-190762).

In recent years, in order to meet demand for implementation of high output of an internal combustion engine, the air-fuel mixture is highly compressed. Thus, in view of reliably preventing outward leakage of the air-fuel mixture and the like for ensuring good gastightness, there is conceived enhancement of a seal between the sheet packing and each of the taper portion and the stepped portion through increase in crimping force applied to the rear end opening portion of the metallic shell.

However, increasing the crimping force may involve large deformation of the sheet packing, potentially resulting in radially inward or outward protrusion of the sheet packing from between the taper portion and the stepped portion. As a result, a radially inward protrusion of the sheet packing may squeeze the insulator, or a radially outward protrusion of the sheet packing may enter between the insulator and the metallic shell, potentially resulting in breakage, such as cracking, of the insulator.

The present invention has been conceived in view of the above circumstances, and an object of the invention is to provide a spark plug for an internal combustion engine in which, while gastightness is improved through increase in crimping force, deformation of a sheet packing associated with increase in crimping force can be restrained and in turn, breakage of an insulator can be more reliably prevented.

SUMMARY OF THE INVENTION

Configurations suitable for achieving the above object will next be described in itemized form. If needed, actions and effects peculiar to the configurations will be additionally described.

Configuration 1. In accordance with a first aspect of the present invention, there is provided a spark plug for an internal combustion engine comprised of an insulator having an axial hole extending in a direction of an axis and a stepped portion provided on an outer circumferential portion thereof and tapering frontward in the direction of the axis; an annular sheet packing; and a substantially tubular metallic shell having a taper portion provided on an inner circumferential portion thereof and tapering frontward in the direction of the axis, and holding the insulator through a rear end portion thereof being crimped with the stepped portion being seated on the taper portion via the sheet packing. The spark plug is characterized in that the taper portion has a groove.

Since protrusion of the sheet packing can be restrained, crimping force applied to a rear end portion of the metallic shell can be increased, and in turn, gastightness can be further enhanced.

Configuration 2. In accordance with a second aspect of the present invention, there is provided a spark plug for an internal combustion engine as described above, characterized in that, the groove has a depth of 0.005 mm or greater and of one-half or less a thickness of the sheet packing.

Configuration 3. In accordance with a third aspect of the present invention, there is provided a spark plug for an internal combustion engine as described in configurations 1 or 2 mentioned above, wherein the groove has a width of 0.005 mm or greater and of 70% or less of a width of the sheet packing.

Configuration 4. In accordance with a fourth aspect of the present invention, there is provided a spark plug for an internal combustion engine as described in any one of configurations 1 to 3 mentioned above, wherein the groove is formed annularly with the axis serving as the center.

Configuration 5. In accordance with a fifth aspect of the present invention, there is provided a spark plug for an internal combustion engine as described in any one of configurations 1 to 4 mentioned above, wherein the groove includes a first groove and a second groove such that, as viewed on a section which contains the axis, with L representing a distance between an outer circumference and an inner circumference of a contact portion between the sheet packing and the taper portion, the first groove is located within an inner ⅓ region of the contact portion and has a width of 0.1 L or greater, and the second groove is located within an outer ⅓ region of the contact portion and has a width of 0.1 L or greater.

The first (second) groove may have a width of 0.1 L or greater, as follows. There may be provided a single groove having a width of 0.1 L or greater. Alternatively, a plurality of grooves may be provided such that the total of their widths is 0.1 L or greater. Therefore, for example, while a single groove having a width of 0.1 L is provided within the inner ⅓ region, two grooves each having a width of 0.05 L are provided within the outer ⅓ region.

Configuration 6. In accordance with a sixth aspect of the present invention, there is provided a spark plug for an internal combustion engine as described in any one of configurations 1 to 5 mentioned above, wherein the metallic shell has a threaded portion to be threadingly engaged with a mounting hole of a head of an internal combustion engine, and a seat portion provided rearward of the threaded portion and having a diameter greater than a thread diameter of the threaded portion and a distance along the axis between the seat portion and a front end of the metallic shell is 25 mm or greater.

In recent years, for enhancement of heat radiation, there is proposed a spark plug having an elongated distance between the seat portion and the front end of the metallic shell (a so-called long-reach-type plug). In such a spark plug, the distance between the sheet packing and a rear end portion (crimp portion) of the metallic shell; i.e., the length along the axis of a portion (insulator-holding portion) of the metallic shell used to hold the insulator, is relatively long. Accordingly, in the course of use of the plug, the insulator-holding portion exhibits a relatively large elongation associated with thermal expansion, potentially resulting in an impairment in a seal between the metallic shell and the insulator and in turn an impairment in gastightness of a combustion chamber. Thus, increasing crimping force to be applied to a rear end portion of the metallic shell is conceived for preventing an impairment in gastightness. However, as mentioned above, increasing the crimping force may cause deformation of the sheet packing and associated breakage of the insulator, or a like problem. That is, in an attempt to maintain sufficient gastightness, the long-reach-type spark plug is more likely to suffer the occurrence of such problem.

Configuration 7. In accordance with a seventh aspect of the present invention, there is provided a spark plug for an internal combustion engine as described above in any one of configurations 1 to 6 mentioned above, wherein the taper portion and the sheet packing are such that at least one of a surface of the taper portion and a surface of the sheet packing is covered with plating.

Configuration 8. In accordance with an eighth aspect of the present invention, there is provided a spark plug for an internal combustion engine as described in configuration 7 mentioned above, wherein the plating is zinc plating.

Configuration 9. In accordance with a ninth aspect of the present invention, there is provided a spark plug for an internal combustion engine as described in configuration 8 mentioned above, wherein the taper portion and the sheet packing are such that a surface of the taper portion and a surface of the sheet packing are covered with zinc plating.

According to configuration 1, the taper portion has the groove. Thus, when the sheet packing is deformed as a result of crimping a rear end portion of the metallic shell, a portion of the sheet packing bulges into the groove. In other words, a portion of the sheet packing which, in the case of a flat taper portion, would spread radially outward or inward as a result of the aforementioned crimping, can at least partially bulge into the groove. As a result, radially outward or inward protrusion of the sheet packing can be more reliably prevented.

Further, the provision of the groove at the taper portion can increase frictional resistance of the surface of the taper portion. Thus, coupled with the effect yielded by the bulging of a portion of the sheet packing into the groove as mentioned above, movement (radially outward or inward movement) of the sheet packing relative to the taper portion can be more reliably restrained, whereby protrusion of the sheet packing can be further restrained.

Configuration 2 specifies a depth of the groove of 0.005 mm or greater. Thus, a portion of the sheet packing which bulges into the groove can be increased in volume, and frictional resistance of the surface of the taper portion can be further increased. As a result, protrusion of the sheet packing can be more reliably restrained, whereby breakage of the insulator can be more reliably prevented.

Additionally, since the depth of the groove is specified to be one-half or less the thickness of the sheet packing, a sufficient seal can be ensured between the taper portion and the sheet packing, whereby excellent gastightness can be implemented.

Configuration 3 specifies a width of the groove of 0.005 mm or greater; thus, a wider range of the sheet packing can bulge into the groove. Therefore, protrusion of the sheet packing can be further restrained, whereby breakage of the insulator can be further prevented.

Also, through employment of a width of the groove of 70% or less of the width of the sheet packing, the sheet packing can be more reliably brought into close contact with the taper portion, whereby gastightness can be further enhanced.

According to configuration 4, the groove is formed annularly with the axis serving as the center. Thus, an annular shape can be imparted to a contact portion between the sheet packing and a surface of the taper portion where the groove is not formed; i.e., to a portion where the taper portion and the sheet packing are in close contact with each other. Therefore, outward leakage of air-fuel mixture and the like which enter between the insulator and the metallic shell can be more effectively prevented, whereby gastightness can be further enhanced.

Also, through provision of the circumferentially continuous groove, the sheet packing can bulge into the groove along the circumferential direction. By virtue of this, protrusion of the sheet packing can be restrained evenly along the entire circumference, whereby breakage of the insulator can be more reliably prevented.

According to configuration 5, the groove having a width of 0.1 L or greater is provided in each of the inner ⅓ region and the outer ⅓ region of the contact portion between the sheet packing and the taper portion. Thus, an inner circumferential portion and an outer circumferential portion of the sheet packing, which portions are particularly likely to protrude, can bulge into the first groove and the second groove, respectively. Also, since each of the grooves has a width of 0.1 L or greater, a wide range of an inner circumferential portion and a wide range of an outer circumferential portion of the sheet packing can bulge into the respective grooves. As a result, radially inward and outward protrusion of the sheet packing can be more reliably prevented, whereby damage to the insulator can be more reliably prevented.

The spark plug of configuration 6 has a relatively long distance along the axis of 25 mm or greater between the seat portion and the front end of the metallic shell and is thus more likely to suffer the above-mentioned problem. However, the employment of the configurations mentioned above can more reliably prevent the occurrence of such problem. In other words, the configurations mentioned above are particularly effective for a spark plug having a relatively long distance between the seat portion and the front end of the metallic shell.

According to configuration 7, at least one of the surface of the taper portion and the surface of the sheet packing is covered with plating. Thus, frictional resistance between the taper portion and the sheet packing can be further increased, whereby movement of the sheet packing relative to the taper portion can be reliably restrained. As a result, protrusion of the sheet packing can be more reliably prevented.

According to configuration 8, the plating is zinc plating. By virtue of this, frictional resistance between the taper portion and the sheet packing can be drastically increased, whereby protrusion of the sheet packing can be more reliably prevented.

According to configuration 9, both of the taper portion and the sheet packing are covered with zinc plating. Thus, frictional resistance between the taper portion and the sheet packing can be further increased. As a result, protrusion of the sheet packing can be more effectively prevented.

BRIEF DESCRIPTION OF THE DRAWINGS

FIGS. 6(*a*) to 6(*c*) are enlarged sectional views for schematically explaining the position and width of the groove of samples in an evaluation test.

DETAILED DESCRIPTION OF PREFERRED EMBODIMENTS

Figure 1:
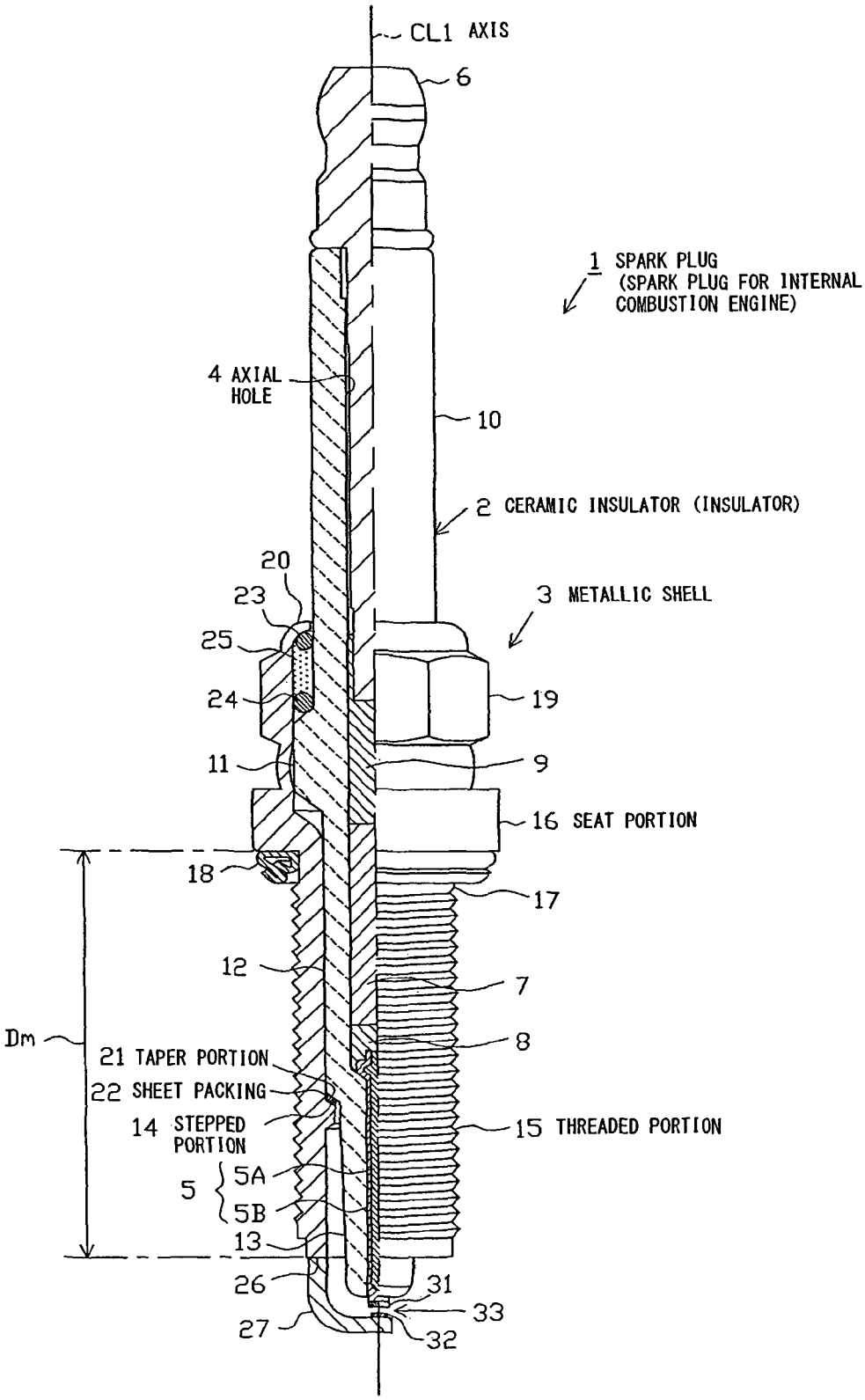
FIG. 1 is a partially cutaway front view showing the configuration of a spark plug.

An embodiment of the present invention will next be described with reference to the drawings. FIG. 1 is a partially cutaway front view showing a spark plug 1 for an internal combustion engine (hereinafter, referred to as a "spark plug"). In FIG. 1, the direction of an axis CL1 of the spark plug 1 is referred to as the vertical direction. In the following description, the lower side of the spark plug 1 in FIG. 1 is referred to as the front side of the spark plug 1, and the upper side as the rear side.

The spark plug 1 includes a ceramic insulator 2, which is the tubular insulator in the present invention, and a tubular metallic shell 3, which holds the ceramic insulator 2 therein.

The ceramic insulator 2 is formed from alumina or the like by firing, as is well known in the art. The ceramic insulator 2, as viewed externally, includes a rear trunk portion 10 formed on the rear side; a large-diameter portion 11, which is located frontward of the rear trunk portion 10 and which projects radially outward; an intermediate trunk portion 12, which is located frontward of the large-diameter portion 11 and which is smaller in diameter than the large-diameter portion 11; and a leg portion 13, which is located frontward of the intermediate trunk portion 12 and which is smaller in diameter than the intermediate trunk portion 12. The large-diameter portion 11, the intermediate trunk portion 12, and most of the leg portion 13 of the ceramic insulator 2 are accommodated in the metallic shell 3. A tapered, stepped portion 14, which tapers frontward in the direction of the axis CL1, is formed at a connection portion between the leg portion 13 and the intermediate trunk portion 12. The ceramic insulator 2 is seated on the metallic shell 3 at the stepped portion 14.

The ceramic insulator 2 has an axial hole 4 extending therethrough along the axis CL1. A center electrode 5 is fixedly inserted into a front end portion of the axial hole 4. The center electrode 5 includes an inner layer 5A made of copper or a copper alloy, and an outer layer 5B made of an Ni alloy which contains nickel (Ni) as a main component. The center electrode 5 assumes a rodlike (circular columnar) shape as a whole; has a flat front end surface; and projects from the front end of the ceramic insulator 2. A circular columnar noble metal tip 31 made of a noble metal alloy (e.g., an iridium alloy) is joined to a front end portion of the center electrode 5.

Also, a terminal electrode 6 is fixedly inserted into a rear end portion of the axial hole 4 and projects from the rear end of the ceramic insulator 2.

Further, a circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

The metallic shell 3 is formed into a tubular shape from a low-carbon steel or a like metal. The metallic shell has, on its outer circumferential surface, a threaded portion (externally threaded portion) 15 adapted to mount the spark plug 1 to an engine head. Also, the metallic shell 3 has, on its outer circumferential surface, a seat portion 16 located rearward of the threaded portion 15. A ring-like gasket 18 is fitted to a screw neck 17 at the rear end of the threaded portion 15. Further, the metallic shell 3 has, near the rear end thereof, a tool engagement portion 19 having a hexagonal cross section and allowing a tool, such as a wrench, to be engaged therewith when the spark plug 1 is to be mounted to the engine head. Also, the metallic shell 3 has a crimp portion 20 provided at a rear end portion thereof for retaining the ceramic insulator 2. In the present embodiment, in order to improve heat radiation of the spark plug 1, distance Dm along the axis CL1 between the seat portion 16 and the front end of the metallic shell 3 is rendered relatively long (e.g., 25 mm or more).

Further, the metallic shell 3 has, on its inner circumferential surface, a taper portion 21 tapering frontward in the direction of the axis CL1 and adapted to allow the ceramic insulator 2 to be seated thereon. The ceramic insulator 2 is inserted frontward into the metallic shell 3 from the rear end of the metallic shell 3. In a state in which the stepped portion 14 of the ceramic insulator 2 butts against the taper portion 21 of the metallic shell 3, a rear-end opening portion of the metallic shell 3 is crimped radially inward; i.e., the crimp portion 20 is formed, whereby the ceramic insulator 2 is held by the metallic shell 3. An annular sheet packing 22 intervenes between the stepped portion 14 of the ceramic insulator 2 and the taper portion 21 of the metallic shell 3. This retains gastightness of a combustion chamber and prevents outward leakage of air-fuel mixture through a clearance between the inner circumferential surface of the metallic shell 3 and the leg portion 13 of the ceramic insulator 2, which leg portion 13 is exposed to the combustion chamber.

In order to ensure gastightness which is established by crimping, annular ring members 23 and 24 intervene between the metallic shell 3 and the insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

A ground electrode 27 is joined to a front end portion 26 of the metallic shell 3 and is bent at an intermediate portion thereof such that a side surface thereof faces a front end portion of the center electrode 5. Additionally, a circular columnar noble metal tip 32 made of a noble metal alloy (e.g., a platinum alloy) is joined to a distal end portion of the ground electrode 27. A spark discharge gap 33 is formed between the noble metal tips 31 and 32. Spark discharges are generated across the spark discharge gap 33 substantially along the direction of the axis CL1.

Figure 2:
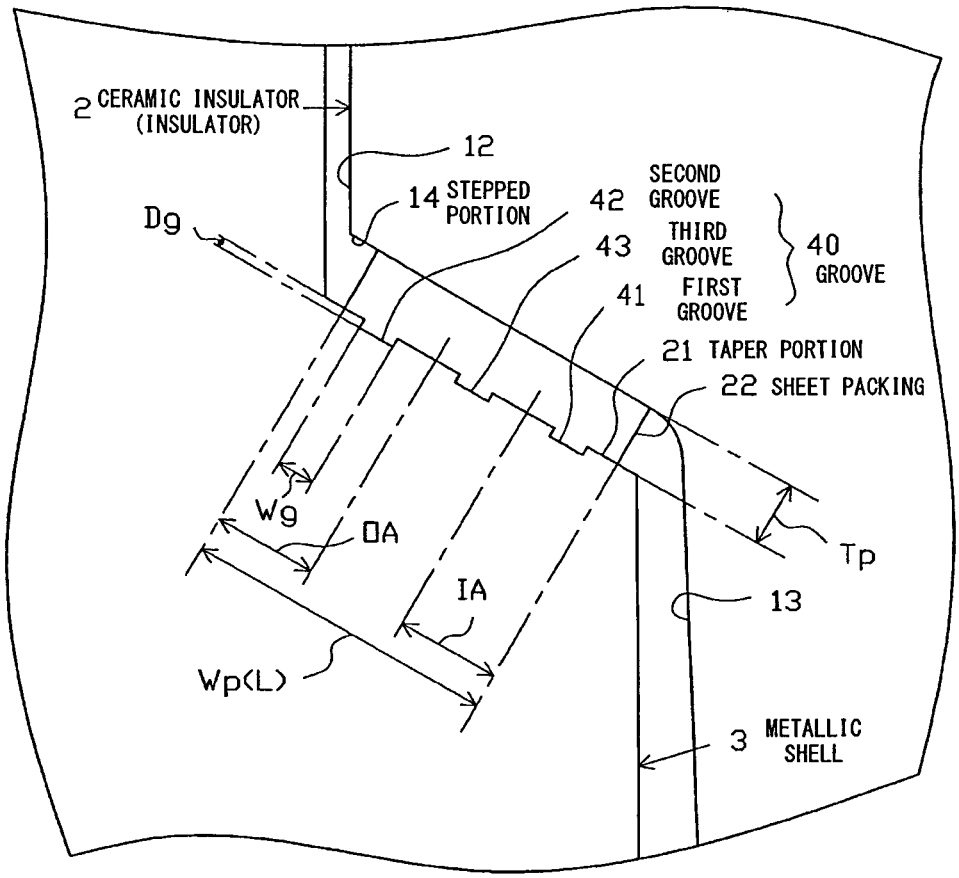
FIG. 2 is an enlarged sectional view schematically showing the constitution of a taper portion, etc.
Figure 3:
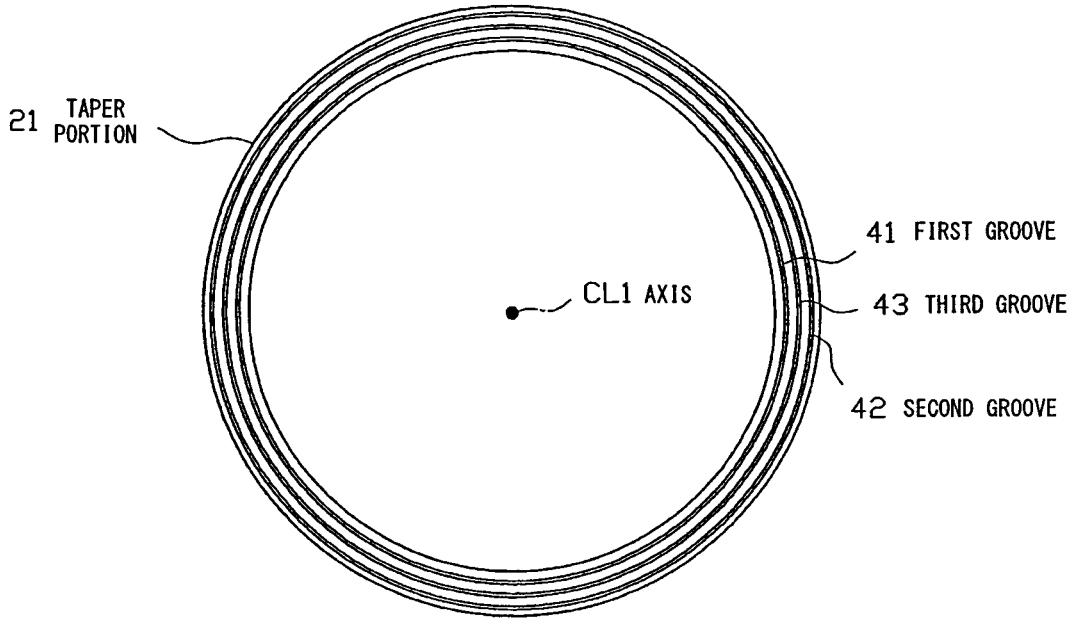
FIG. 3 is an enlarged schematic plan view showing the shape of a groove.

Further, as shown in FIGS. 2 and 3, an annular groove 40 is formed, with the axis CL1 serving as the center, in a surface of the taper portion 21 of the metallic shell 3 which is in contact with the sheet packing 22. In the embodiment shown, the groove 40 includes a first groove 41, a second groove 42, and a third groove 43 and the grooves 41 to 43 have the same width Wg, which is 0.005 mm or greater and 70% or less of width Wp (e.g., 1 mm) of the sheet packing 22. Also, the grooves 41 to 43 have the same depth Dg, which is 0.005 mm or greater and one-half or less the thickness Tp (e.g., 0.2 mm) of the sheet packing 22.

Further, as viewed on a section which contains the axis CL1, with L representing the distance between the outer circumference and the inner circumference of a contact portion between the sheet packing 22 and the taper portion 21 (in the present embodiment, distance L is equal to width Wp of the sheet packing 22), the first groove 41 is provided within an inner ⅓ region (inner circumferential region) IA of the contact portion. Further, the second groove 42 is provided within an outer ⅓ region (outer circumferential region) OA of the contact portion. Additionally, the width Wg of each of the grooves 41 and 42 is 0.1 L or greater.

Additionally, the entire surface of the sheet packing 22 is covered with plating (e.g., zinc plating).

Next, a method of manufacturing the spark plug 1 configured as mentioned above is described. First, the metallic shell 3 is formed beforehand. Specifically, a circular columnar metal material (e.g., an iron-based material, such as S17C or S25C, or a stainless steel material) is subjected to cold forging or the like for forming a through hole, thereby forming a general shape. Subsequently, machining is conducted so as to adjust the outline, thereby yielding a metallic-shell intermediate.

Subsequently, the ground electrode 27 having the form of a straight rod and formed of an Ni alloy is resistance-welded to the front end surface of the metallic-shell intermediate. The resistance welding is accompanied by formation of so-called "slags." After the "slags" are removed, the threaded portion 15 is formed in a predetermined region of the metallic-shell intermediate by rolling. Thus is yielded the metallic shell 3 to which the ground electrode is welded. The metallic shell 3 to which the ground electrode 27 is welded is subjected to zinc plating or nickel plating. In order to enhance corrosion resistance, the plated surface may be further subjected to chromate treatment. After the plating process, plating is removed from a distal end portion of the ground electrode 27.

Separately from preparation of the metallic shell 3, the ceramic insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping the outline. The shaped green compact is placed in a kiln, followed by firing for forming the insulator 2.

Separately from preparation of the metallic shell 3 and the ceramic insulator 2, the center electrode 5 is formed. Specifically, center electrode 5 is formed by forging and is comprised of a Ni alloy having a copper alloy disposed in a central portion thereof to enhance heat radiation. Next, the noble metal tip 31 is joined to a front end portion of the center electrode 5 by laser welding or the like.

Additionally, the sheet packing 22 is fabricated as follows: a mild steel sheet softer than a metal material used to form the metallic shell 3 is subjected to blanking, and the yielded blank is subjected to carburizing or carbonitriding. Next, the sheet packing 22 is plated with zinc, thereby forming a zinc plating film on the surface of the sheet packing 22. The sheet packing 22 before attachment is in the form of a substantially flat sheet.

Then, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the ceramic insulator 2 such that the resistor 7 is sandwiched therebetween. Subsequently, the resultant assembly is heated in a kiln under conditions wherein the charged mixture is pressed from the rear by the terminal electrode 6, thereby being fired and fixed. At this time, a glaze layer may be simultaneously fired on the surface of the rear trunk portion 10 of the ceramic insulator 2; alternatively, the glaze layer may be formed beforehand.

Subsequently, the thus-formed ceramic insulator 2 having the center electrode 5 and the terminal electrode 6, and the thus-formed metallic shell 3 having the ground electrode 27 are assembled together. Specifically, with the sheet packing 22 being disposed on the taper portion 21, the ceramic insulator 2 is inserted from a rear-end opening portion of the through hole of the metallic shell 3. Then, a relatively thin-walled rear-end opening portion of the metallic shell 3 is crimped radially inward (i.e., the crimp portion 20 is formed), thereby assembling the ceramic insulator 2 and the metallic shell 3 together. As a result of crimping mentioned above, the substantially flat sheet packing 22 is deformed along the stepped portion 14 of the ceramic insulator 2 and along the taper portion 21 of the metallic shell 3. Thus, the sheet packing 22 comes into close contact with the stepped portion 14 and the taper portion 21 and partially bulges into the grooves 41 to 43. In the present embodiment, in order to prevent a drop in holding force of the metallic shell 3 holding the ceramic insulator 2, which drop would otherwise result from thermal expansion etc., the rear-end opening portion of the metallic shell 3 is crimped with relatively large crimping force.

Next, the noble metal tip 32 is resistance-welded to the distal end portion, from which plating is removed, of the ground electrode 27. Finally, a substantially intermediate portion of the ground electrode 27 is bent, thereby adjusting the spark discharge gap 33 between the noble metal tips 31 and 32. Thus, the spark plug 1 described above is yielded.

As described in detail above, according to the present embodiment, the groove 40 (first to third grooves 41 to 43) is provided on a surface of the taper portion 21 which is in contact with the sheet packing 22. Thus, when the sheet packing 22 is deformed as a result of crimping a rear end portion of the metallic shell 3, a portion of the sheet packing 22 bulges into the groove 40. That is, a portion of the sheet packing 22 which, in the case of a flat taper portion, would spread radially outward or inward can at least partially bulge into the groove 40. As a result, radially outward or inward protrusion of the sheet packing 22 can be more reliably prevented.

Further, the provision of the groove 40 on the taper portion 21 can increase frictional resistance of the surface of the taper portion 21. Thus, coupled with the effect yielded by the bulging of a portion of the sheet packing 22 into the groove 40 as mentioned above, movement (radially outward or inward movement) of the sheet packing 22 relative to the taper portion 21 can be more reliably restrained, whereby protrusion of the sheet packing 22 can be further restrained.

Also, since protrusion of the sheet packing 22 can be restrained, crimping force applied to a rear end portion of the metallic shell 3 can be increased, and in turn, gastightness can be further enhanced.

Additionally, since the depth Dg of the groove 40 is specified to be 0.005 mm or greater, a portion of the sheet packing 22 which bulges into the groove 40 can be increased in volume, and frictional resistance of the surface of the taper portion 21 can be further increased. As a result, protrusion of the sheet packing 22 can be more reliably restrained, whereby breakage of the ceramic insulator 2 can be more reliably prevented. Also, since the depth Dg of the groove 40 is specified to be one-half or less the thickness Tp of the sheet packing 22, a sufficient seal can be ensured between the taper portion 21 and the sheet packing 22, whereby excellent gastightness can be implemented.

Further, since the width Wg of the groove 40 is specified to be 0.005 mm or greater, a wider range of the sheet packing 22 can bulge into the groove 40. Therefore, protrusion of the sheet packing 22 can be further restrained, whereby breakage of the ceramic insulator 2 can be further prevented. Also, through employment of a width Wg of the groove 40 of 70% or less of the width Wp of the sheet packing 22, the sheet packing 22 can be more reliably brought into close contact with the taper portion 21, whereby gastightness can be further enhanced.

Also, since the groove 40 is formed annularly with the axis CL1 serving as the center, an annular shape can be imparted to a contact portion between the sheet packing 22 and a surface of the taper portion 21 where the groove 40 is not formed; i.e., to a portion where the taper portion 21 and the sheet packing 22 are in close contact with each other. Therefore, outward leakage of air-fuel mixture and the like which enter between the metallic shell 3 and the ceramic insulator 2 can be more effectively prevented, whereby gastightness can be further enhanced. Also, through provision of the circumferentially continuous groove 40, the sheet packing 22 can bulge into the groove 40 along the circumferential direction. By virtue of this, protrusion of the sheet packing 22 can be restrained along the entire circumference.

Additionally, the first groove 41 and the second groove 42 each having a width of 0.1 L or greater are provided in the inner region IA and the outer region OA, respectively, of the contact portion between the sheet packing 22 and the taper portion 21. Thus, an inner circumferential portion and an outer circumferential portion of the sheet packing 22, which portions are particularly likely to protrude, can bulge into the first groove 41 and the second groove 42, respectively. Also, since each of the grooves 41 and 42 has a width of 0.1 L or greater, a wide range of an inner circumferential portion and a wide range of an outer circumferential portion of the sheet packing 22 can bulge into the grooves 41 and 42, respectively. As a result, radially inward and outward protrusion of the sheet packing can be more reliably prevented, whereby damage to the ceramic insulator 2 can be more reliably prevented.

Also, since the surface of the taper portion 21 is covered with zinc plating, frictional resistance between the taper portion 21 and the sheet packing 22 can be further increased, and in turn, protrusion of the sheet packing 22 can be more reliably prevented.

Figure 4:
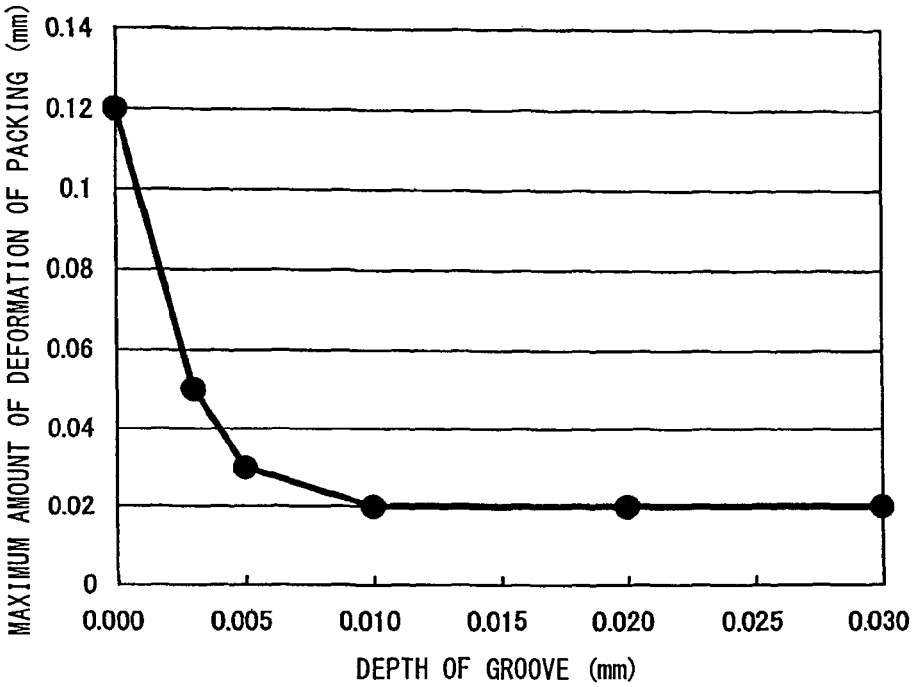
FIG. 4 is a graph showing the relation between the depth of the groove and the maximum amount of deformation of a packing.
Figure 5:
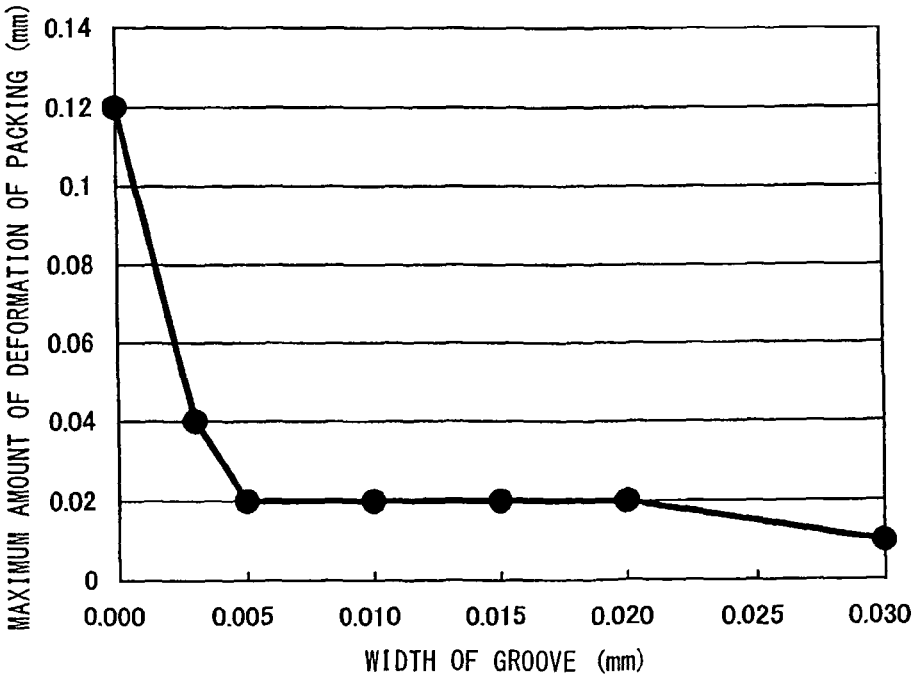
FIG. 5 is a graph showing the relation between the width of the groove and the maximum amount of deformation of the packing.

Next, in order to verify actions and effects yielded by the present embodiment, a packing deformation-amount evaluation test was conducted. The packing deformation-amount evaluation test is briefly described below. Spark plug samples were fabricated in such a manner that ceramic insulators were assembled to respective metallic shells which differed in width and depth of the groove formed at the taper portion. After assembly, the samples were measured for the maximum amount of radially outward or inward protrusion of the sheet packing from between the taper portion and the stepped portion of the ceramic insulator (maximum amount of deformation of the packing). FIG. 4 is a graph showing the relation between the depth of the groove and the maximum amount of deformation of the packing. FIG. 5 is a graph showing the relation between the width of the groove and the maximum amount of deformation of the packing. In the test whose results are shown in FIG. 4, the width of the groove was 0.010 mm. In the test whose results are shown in FIG. 5, the depth of the groove was 0.010 mm. Further, the employed sheet packings had a thickness of 0.200 mm and a width of 1.000 mm. The measured values of the width and depth of the groove, the thickness of the sheet packing, etc. are those after assembly (the same convention also applies to the following description).

As shown in FIGS. 4 and 5, as compared with the samples having no groove (i.e., the samples having a depth and width of the groove of 0.000 mm), the samples in which the taper portion has the groove exhibit a great reduction in the maximum amount of deformation of the packing, indicating that protrusion of the sheet packing is effectively restrained. Conceivably, this is for the following reason: through provision of the groove at the taper portion, the sheet packing can bulge into the groove, and frictional resistance against the surface of the taper portion can be increased.

Particularly, the samples having a depth of the groove of 0.005 mm or greater or a width of the groove of 0.005 mm or greater exhibit a maximum amount of deformation of the packing of 0.03 mm or less, indicating that protrusion of the sheet packing can be very effectively restrained.

Next, spark plug samples which differed in the depth and width of the groove were subjected to a gastightness evaluation test. The outline of the gastightness evaluation test is as follows. The samples were mounted to a test bed which simulated an engine head. In a condition in which the seat portions of the samples were heated at 200° C. and an air pressure of 1.5 MPa was applied, air leakage from the interfaces between the metallic shells and the ceramic insulators was checked. When air leakage was observed, evaluation was "poor," indicating an impairment in gastightness. When air leakage was not observed, evaluation was "good," indicating establishment of sufficient gastightness. Table 1 shows the results of the evaluation test on the samples which differ in the depth of the groove. Table 2 shows the results of the evaluation test on the samples which differ in the width of the groove. The thickness of the sheet packing, etc. is similar to those in the above-mentioned packing deformation-amount evaluation test.

TABLE 1

| | Depth of groove (mm) | | | | | | |
|---|---|---|---|---|---|---|---|
| | 0.000 | 0.001 | 0.005 | 0.010 | 0.020 | 0.100 | 0.150 |
| Evaluation | Good | Good | Good | Good | Good | Good | Poor |

TABLE 2

| | Width of groove (mm) | | | | | | | |
|---|---|---|---|---|---|---|---|---|
| | 0.500 | 0.550 | 0.600 | 0.650 | 0.700 | 0.750 | 0.800 | 0.850 |
| Evaluation | Good | Good | Good | Good | Good | Poor | Poor | Poor |

As shown in Table 1, the sample having a depth of the groove of 0.150 mm; i.e., a depth in excess of one-half the thickness (0.200 mm) of the sheet packing, exhibits an impairment in gastightness. Also, as shown in Table 2, the samples having a width of the groove in excess of 0.700 mm; i.e., a width of the groove in excess of 70% of the width of the sheet packing, exhibit an impairment in gastightness. Conceivably, this is for the following reason: since the depth or width of the groove is excessively large, contact of the sheet packing with the taper portion is impaired.

By contrast, the samples having a depth of the groove of 0.100 mm or less (one-half or less the thickness of the sheet packing) or a width of the groove of 0.70 mm or less (70% or less of the width of the sheet packing) exhibit excellent gastightness.

Next, there were fabricated spark plug samples which differed in position of the groove at the taper portion and in width of the groove. The samples were subjected to the packing deformation-amount evaluation test and the gastightness evaluation test. In the packing deformation-amount evaluation test, the samples in which protrusion of the sheet packing was restrained were evaluated more precisely under the following criteria: when radially inward or outward protrusion of the sheet packing is reduced as compared with a prior art spark plug sample (sample having no groove), evaluation is "G (good)," indicating that protrusion of the sheet packing is restrained; and when radially inward or outward protrusion of the sheet packing is reduced greatly as compared with a prior art spark plug sample, evaluation is "Ex (excellent)," indicating that protrusion of the sheet packing is very effectively restrained. The samples had a depth of the groove of 0.010 mm and a distance of 1.000 mm between the inner circumference and the outer circumference of a contact portion between the taper portion and the sheet packing (a width of the contact portion of 1.000 mm).

Additionally, in the samples, the position and width of the groove are determined, with L representing the width of the contact portion between the taper portion and the sheet packing, as follows: in sample 1, a groove having a width of 0.2 L is provided within an inner ⅓ region (inner circumferential region) of the contact portion; in sample 2, a groove having a width of 0.2 L is provided within an outer ⅓ region (outer circumferential region) of the contact portion; in sample 3, a groove having a width of 0.2 L is provided within a region (central region) between the inner circumferential region and the outer circumferential region; in sample 4, a groove having a width of ⅓ L is provided in the entire central region; in sample 5, a groove is provided in such a manner as to extend between a 10% region of the contact portion located radially outward from the inner circumference of the outer circumferential region and a 10% region of the contact portion located radially inward from the outer circumference of the inner circumferential region inclusive; i.e., a groove having a width of 8/15 L is provided at a central portion of the taper portion; in sample 6, a groove having a width of 0.05 L is provided within the outer circumferential region, and a groove having a width of 0.05 L is provided within the inner circumferential region; in sample 7, a groove having a width of 0.15 L is provided within the outer circumferential region, and a groove having a width of 0.05 L is provided within the inner circumferential region; in sample 8, a groove having a width of 0.05 L is provided within the outer circumferential region, and a groove having a width of 0.15 L is provided within the inner circumferential region; and in sample 9, a groove having a width of 0.1 L is provided within each of the inner circumferential region and the outer circumferential region. For example, sample 1 is such that the groove is provided as shown in FIG. 6(*a*); sample 5 is such that the groove is provided as shown in FIG. 6(*b*); and sample 9 is such that the groove is provided as shown in FIG. 6(*c*).

Table 3 shows evaluation of the amount of radially inward protrusion of the sheet packing; evaluation of the amount of radially outward protrusion of the sheet packing; and the results of the gastightness evaluation test.

TABLE 3

| Sample No. | | 1 | 2 | 3 | 4 | 5 | 6 | 7 | 8 | 9 |
|---|---|---|---|---|---|---|---|---|---|---|
| Packing deformation-amount evaluation test | Radially inward protrusion | G | Ex | G | G | Ex | G | G | Ex | Ex |
| | Radially outward protrusion | Ex | G | G | G | Ex | G | Ex | G | Ex |
| Gastightness evaluation test | | G | G | G | G | G | G | G | G | G |

As shown in Table 3, the samples exhibit restraint of protrusion of the sheet packing and good gastightness. Particularly, the samples in which the groove having a width of 0.1 L or greater is provided in the outer circumferential region or the inner circumferential region (samples 1, 2, 5, 7, 8, and 9) have proved that radially outward or inward protrusion of the sheet packing can be greatly restrained. Among these samples, the samples in which the groove having a width of 0.1 L or greater is provided in both the outer circumferential region and the inner circumferential region (samples 5 and 9) have indicated that protrusion of the sheet packing in both the radially outward direction and the radially inward direction is greatly restrained.

Next, spark plug samples classified into Sample A, Sample B, and Sample C were fabricated while gastightness was established at the same level among Samples A, B, and C and was varied stepwise by means of varying crimping force applied to a rear end portion of the metallic shell, wherein the samples belonging to Sample A are such that the groove is formed at the taper portion and the surface of the sheet packing is covered with a zinc plating film; the samples belonging to Sample B are such that the groove is formed at the taper portion, but the zinc plating film is not formed on the sheet packing; and the samples belonging to Sample C are such that neither the groove nor the zinc plating film is provided. The samples were subjected to the packing deformation-amount evaluation test mentioned above and were measured for the maximum amount of deformation of the packing. The expression "gastightness was established at the same level" means that the same amount of air leakage was observed in the gastightness evaluation test mentioned above. Table 4 shows the maximum amount of deformation of the packing in Samples A, B, and C as measured when gastightness (i.e., crimping force) was varied. The "gastightness" column in Table 4 shows leakage ratio. The "leakage ratio" is the ratio of the amount of air leakage of a sample as measured in the gastightness evaluation test mentioned above to the amount of air leakage of a spark plug, as measured in the gastightness evaluation test, which does not have the groove and the zinc plating film and in which a rear end portion of the metallic shell is crimped with such a maximum crimping force as not to cause protrusion of the sheet packing. The smaller the leakage ratio, the greater the crimping force with which a rear end portion of the metallic shell is crimped.

TABLE 4

| Gastightness (leakage ratio) | Maximum amount of deformation of packing (mm) | | |
|---|---|---|---|
| | Sample A | Sample B | Sample C |
| 1.00 | 0 | 0 | 0.000 |
| 0.90 | 0 | 0 | 0.010 |
| 0.75 | 0 | 0 | 0.020 |
| 0.65 | 0 | 0 | 0.040 |

TABLE 4-continued

| Gastightness (leakage ratio) | Maximum amount of deformation of packing (mm) | | |
|---|---|---|---|
| | Sample A | Sample B | Sample C |
| 0.60 | 0 | 0.005 | 0.050 |
| 0.50 | 0 | 0.008 | 0.060 |
| 0.40 | 0.003 | 0.012 | 0.080 |
| 0.25 | 0.006 | 0.015 | 0.100 |
| 0.00 | 0.008 | 0.025 | 0.120 |

As shown in Table 4, in Sample C (according to the prior art), in which the groove and the plating film are not provided, as gastightness is increased in intensity; i.e., crimping force applied to a rear end portion of the metallic shell is increased, protrusion of the sheet packing increases excessively.

By contrast, in Sample B, in which the groove is provided at the taper portion, even when the crimping force is increased for enhancing gastightness, protrusion of the sheet packing can be restrained. Particularly, in Sample A, in which the groove is provided and the zinc plating film is provided on the surface of the sheet packing, protrusion of the sheet packing can be further restrained. Conceivably, this is for the following reason: provision of the zinc plating film on the surface of the sheet packing increases frictional resistance between the taper portion and the sheet packing, thereby restraining movement of the sheet packing relative to the taper portion.

In comprehensive view of the above results of the evaluation tests, provision of the groove at the taper portion is significant in terms of restraint of protrusion of the sheet packing for prevention of damage to the ceramic insulator.

Also, in view of more reliable prevention of protrusion of the sheet packing, employment of a depth of the groove of 0.005 mm or greater and a width of the groove of 0.005 mm or greater is particularly significant.

Additionally, in view of further restraint of protrusion of the sheet packing, preferably, the groove having a width of 0.1 L or greater is provided in the outer circumferential region or the inner circumferential region. More preferably, in view of restraint of protrusion of the sheet packing in both the radially outward direction and the radially inward direction, the groove having a width of 0.1 L or greater is provided in both the outer circumferential region and the inner circumferential region.

Also, provision of the zinc plating film on the surface of the sheet packing can more effectively restrain protrusion of the sheet packing.

Meanwhile, in view of maintenance of sufficient gastightness, preferably, the depth of the groove is one-half or less the thickness of the sheet packing, and the width of the groove is 70% or less of the width of the sheet packing.

The present invention is not limited to the above-described embodiment, but may be embodied, for example, as follows. Of course, applications and modifications other than those described below are also possible.

(a) In the embodiment described above, three grooves; specifically, the first groove 41, the second groove 42, and the third groove 43, are provided. However, the number of the grooves is not limited thereto. Also, the position of the groove 40 is not limited to that of the embodiment described above.

(b) In the embodiment described above, the constituent grooves of the groove 40 have the same width Wg and the same Depth Dg. However, the constituent grooves of the groove 40 may differ in width Wg and in depth Dg. Therefore, although, in the embodiment described above, the constituent grooves of the groove 40 have a depth Dg of 0.005 mm or greater and a width Wg of 0.005 mm or greater, the constituent grooves of the groove 40 may have, for example, a depth Dg of less than 0.005 mm and a width Wg of less than 0.005 mm.

(c) In the embodiment described above, the groove is formed annularly with the axis CL1 serving as the center. However, the shape of the groove 40 is not limited to an annular shape. Therefore, the groove may assume the form of a plurality of depressions provided on the surface of the taper portion 21.

(d) In the embodiment described above, the entire surface of the sheet packing 22 is covered with the zinc plating film. However, only the surface of the sheet packing 22 which faces the taper portion 21 may be covered with the zinc plating film. In place of the surface of the sheet packing 22, the surface of the taper portion 21 may be covered with the zinc plating film, or the surfaces of both the taper portion 21 and the sheet packing 22 may be covered with the zinc plating film.

(e) In the embodiment described above, the sheet packing 22 is plated with zinc. However, the sheet packing 22 may be plated with another metal, such as Ni. Even in this case, frictional resistance between the taper portion 21 and the sheet packing 22 can be increased, whereby movement of the sheet packing 22 relative to the taper portion 21 can be more reliably restrained.

(f) In the embodiment described above, the distance Dm along the axis CL1 between the seat portion 16 and the front end of the metallic shell 3 is rendered relatively long (e.g., 25 mm or more). However, no particular limitation is imposed on the distance Dm along the axis CL1 between the seat portion 16 and the front end of the metallic shell 3.

(g) In the embodiment described above, the noble metal tips 31 and 32 are provided on a front end portion of the center electrode 5 and a distal end portion of the ground electrode 27, respectively. However, both of or one of the noble metal tips 31 and 32 may be eliminated.

(h) In the embodiment described above, the ground electrode 27 is joined to the front end surface of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906). Also, the ground electrode 27 may be joined to a side surface of the front end portion 26 of the metallic shell 3.

(i) In the embodiment described above, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

The invention claimed is:

1. A spark plug for an internal combustion engine comprising:

an insulator having an axial hole extending in a direction of an axis and a stepped portion provided on an outer circumferential portion thereof and tapering frontward in the direction of the axis;

an annular sheet packing; and a substantially tubular metallic shell having a taper portion provided on an inner circumferential portion thereof and tapering frontward in the direction of the axis, and holding the insulator through a rear end portion thereof being crimped with the stepped portion being seated on the taper portion via the sheet packing;

the spark plug being characterized in that the taper portion has a groove, wherein the groove has a depth of 0.005 mm or greater and of one-half or less a thickness of the sheet packing.

2. A spark plug for an internal combustion engine according to claim 1, wherein the groove has a width of 0.005 mm or greater and of 70% or less of a width of the sheet packing.

3. A spark plug for an internal combustion engine according to claim 1, wherein the groove is formed annularly with the axis serving as center.

4. A spark plug for an internal combustion engine according to claim 1, wherein the groove includes a first groove and a second groove such that, as viewed on a section which contains the axis, with L representing a distance between an outer circumference and an inner circumference of a contact portion between the sheet packing and the taper portion, the first groove is located within an inner ⅓ region of the contact portion and has a width of 0.1 L or greater, and the second groove is located within an outer ⅓ region of the contact portion and has a width of 0.1 L or greater.

5. A spark plug for an internal combustion engine according to claim 1, wherein the metallic shell has a threaded portion to be threadingly engaged with a mounting hole of a head of an internal combustion engine and a seat portion provided rearward of the threaded portion and having a diameter greater than a thread diameter of the threaded portion, and a distance along the axis between the seat portion and a front end of the metallic shell is 25 mm or greater.

6. A spark plug for an internal combustion engine according to claim 1, wherein the taper portion and the sheet packing are such that at least one of a surface of the taper portion and a surface of the sheet packing is covered with plating.

7. A spark plug for an internal combustion engine according to claim 6, wherein the plating is zinc plating.

8. A spark plug for an internal combustion engine according to claim 7, wherein the taper portion and the sheet packing are such that a surface of the taper portion and a surface of the sheet packing are covered with zinc plating.

* * * * *